United States Patent [19]

Thorsell

[11] 4,036,093

[45] July 19, 1977

[54] SAW FOR CUTTING TRUSS MEMBERS, RAFTERS AND THE LIKE WITH DIMENSIONAL ACCURACY

[75] Inventor: Roland H. Thorsell, Corvallis, Oreg.

[73] Assignee: Excor, Inc., Corvallis, Oreg.

[21] Appl. No.: 715,620

[22] Filed: Aug. 18, 1976

[51] Int. Cl.[2] ..... B27B 5/20

[52] U.S. Cl. ..... 83/471.3; 83/581; 83/488

[58] Field of Search ..... 83/477.1, 471.2, 471.3, 83/486.1, 486, 581, 455, 380, 390, 487, 488

[56] References Cited

U.S. PATENT DOCUMENTS

| | | | |
|---|---|---|---|
| 834,206 | 10/1906 | Kantner | 83/471.3 |
| 3,263,544 | 8/1966 | Margolien | 83/581 |
| 3,315,554 | 4/1967 | Jaegers | 83/488 |
| 3,853,028 | 12/1974 | Jägers | 83/471.3 |
| 3,946,631 | 3/1976 | Malm | 83/471.3 |

*Primary Examiner*—Donald R. Schran
*Attorney, Agent, or Firm*—D. Paul Weaver

[57] ABSTRACT

A power saw for rapid repetitive and accurate cutting of truss members and the like at predetermined angles to insure tight fitting truss joints. The power saw is cycled vertically in a reciprocating mode after being set at a precise cutting angle. Cooperating adjustable angle stops make possible a wide range of accurate angle cuts. A power-operated retractable fence or work positioner and a coacting power workpiece clamp are provided, as well as means to adjust the saw for fence line or workpiece center line cutting.

14 Claims, 5 Drawing Figures

FIG. 2
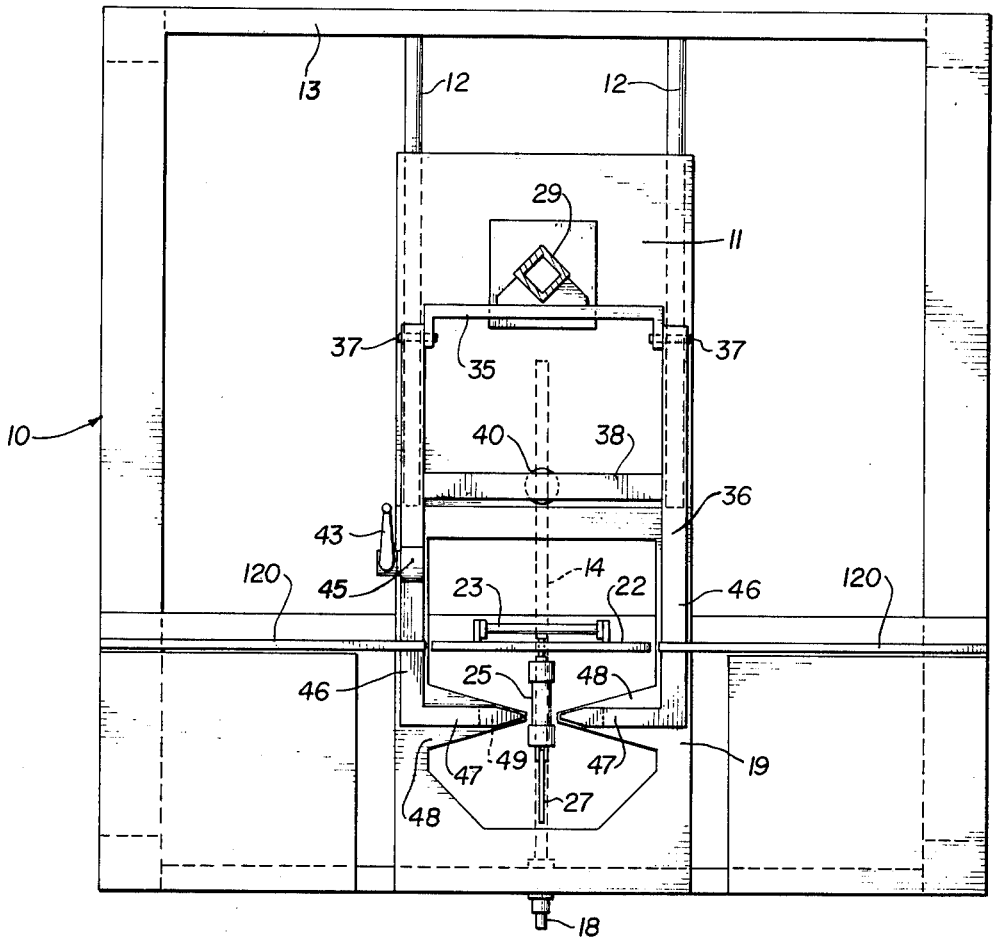
FIG. 3
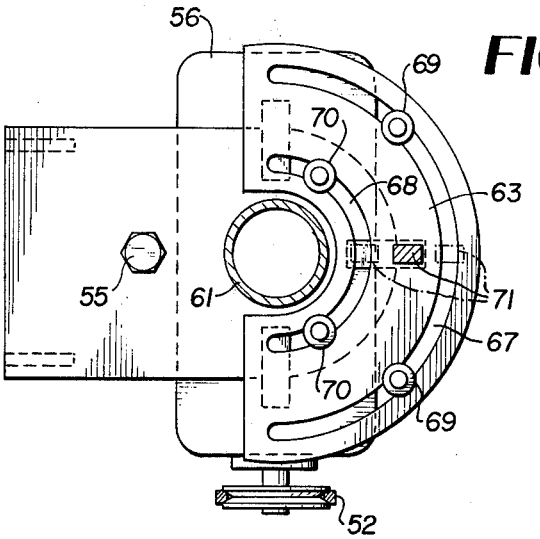
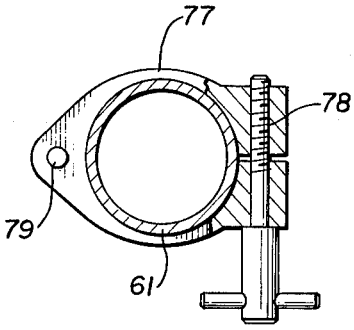
FIG. 4

SAW FOR CUTTING TRUSS MEMBERS, RAFTERS AND THE LIKE WITH DIMENSIONAL ACCURACY

BACKGROUND OF THE INVENTION

Roof and floor trusses constructed from dimensional lumber, such as 2 × 4's and 2 × 6's, have their members joined by metal plates, and such members require very accurate predetermined angle cutting to insure tight fitting joints in the truss. Without tight fitting joints, the truss loses considerable strength. As a result, manufactured trusses must be rejected if the joint gap is too great as a result of inaccurate length or angle cutting.

With the above in mind, the objective of this invention is to provide a machine for cutting roof and floor truss components with high accuracy and rapidly on a repetitive basis.

A further object of the invention is to provide a sawing machine of the above character with provisions for making a wide range of angle cuts with high dimensional accuracy.

Another object is to provide such a machine which may be readily adjusted to perform either "fence line cutting" or "center line cutting" of truss members or like work.

Still another object is to provide a machine capable of firmly holding short lengths of lumber so that various angle cuts can be made without movement of the material or endangering the operator of the machine.

Another object is to provide means for firmly locking the power saw at a preselected angle without play or backlash.

Still another object is to provide a machine of the above-mentioned character which has a retractable work positioning stop or fence.

Another object is to provide a machine of the mentioned character which, following preliminary manual adjustments, is semi-automatic in its operation.

Other features and advantages of the invention will become apparent during the course of the following description.

BRIEF DESCRIPTION OF DRAWING FIGURES

FIG. 2 is a horizontal section taken on line 2—2 of FIG. 1.

FIG. 3 is an enlarged fragmentary horizontal section taken on line 3—3 of FIG. 1.

FIG. 4 is a similar view taken on line 4—4 of FIG. 1.

DETAILED DESCRIPTION

Figure 1:
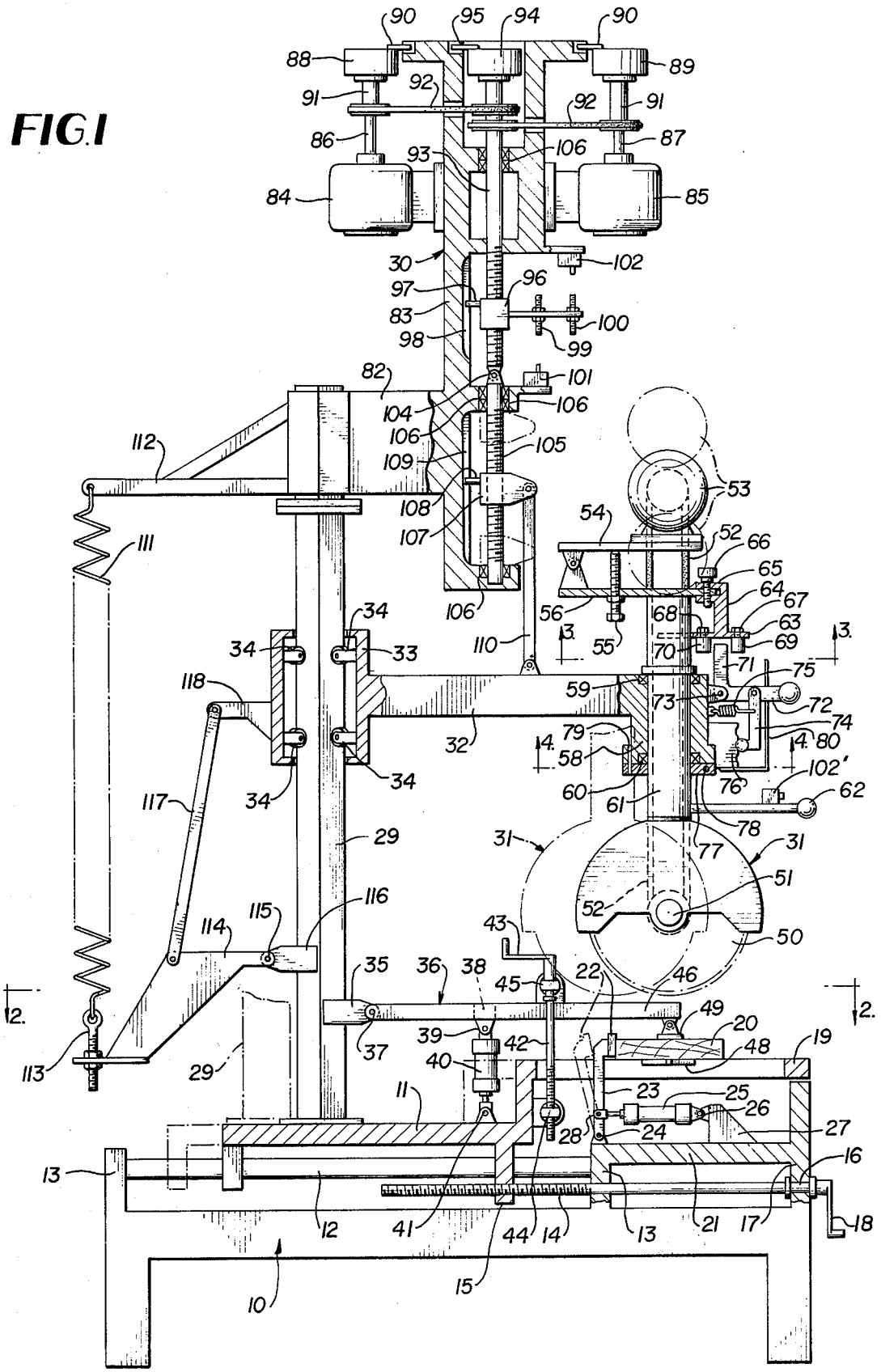
FIG. 1 is a side elevation, partly in vertical cross section, of a saw embodying the invention.

Referring to the drawings in detail wherein like numerals designate like parts, the numeral 10 designates a sturdy machine base or table on which is mounted for fore and aft adjustment a horizontal carriage 11 upon which the entire saw means and its controls and drive are mounted. The carriage 11 is slidably mounted on a pair of spaced parallel fore-to-aft guide bars 12 secured fixedly at their opposite ends to vertical walls 13 of the base 10. The carriage 11 is moved forwardly and rearwardly horizontally at proper times by a horizontal screw shaft 14 having threaded engagement with a depending web 15 of the carriage and swiveled engagement as at 16 with a forward vertical wall 17 of table 10.

A forward hand crank 18 is provided on the screw shaft 14 for turning it.

The carriage 11 has a forward elevated horizontal section 19 defining a level table for the support of wooden truss members or other like workpieces 20 to be cut at predetermined angles. Such workpieces may be relatively long or quite short and the machine is capable of handling both types, as will be further explained.

Mounted on a horizontal web 21 of stationary table 10 is a movable fence 22, or work positioning stop, secured rigidly to the top of a vertically swingable frame 23 having its lower end pivoted at 24 to the table web 21 near the rear thereof. The fore and aft swinging movement of the fence 22 and its frame 23 is obtained at proper times by a pneumatic cylinder 25 having its forward end connected as at 26 to a fixed bracket 27 on the web 21 of the base. The piston rod end of cylinder 25 is connected as at 28 to the swingable frame 23 of fence 22. By this means, the fence 22 may be utilized to accurately position short truss members 20 prior to clamping them to the work table 19, and following such clamping, by means to be described, the fence 22 is retracted to the dotted line position in FIG. 1 so as to be clear of the cutting saw.

A support and saw arm guidance post 29, preferably of rectangular cross section, is secured fixedly to the carriage 11 and rises vertically thereabove for a considerable distance. This single post 29 forms the support for an overhead power-driven saw reciprocating means 30, to be fully described, and also forms the support and guidance means for a power-operated circular saw 31 and associated parts including a horizontal saw support arm 32 and its attached vertically movable carriage 33 having preferably ball bearing guide rollers 34 in contact with the post 29.

Also attached to the post 29 somewhat above the carriage 11 is a rigid bracket means 35 to which a workpiece clamp frame 36 is pivotally attached at 37 for vertical swinging movement. The frame 36 has an intermediate crossbar 38 to which is attached at 39 the upper end of a vertical pneumatic cylinder 40 whose lower rod end is attached at 41 to the carriage 11. This cylinder is utilized at proper times to raise and lower the frame 36, for clamping and releasing the workpiece 20 with a quick action. To minimize travel time of clamp pads 49, preliminary adjustment of the frame 36 to accommodate truss members of a certain thickness may be accomplished manually by the use of a screw shaft 42 having an upper hand crank 43, the screw shaft having swiveled threaded engagement with the carriage 11 as at 44 and having swiveled engagement with the frame 36 at 45. There is end play in the shaft 42 relative to swingable frame 36, whereby following approximate adjustment of the frame by the screw shaft 42, the pneumatic cylinder 40 may be used to effect the clamping and releasing of the truss member 20 with a quick action.

The swinging frame 36 has a pair of side arms 46 whose leading ends 47 are turned inwardly to overlie opposing tapered work table sections 48. The lateral frame ends 47 have pivotally attached to their bottoms above table portions 48 self-aligning workpiece clamp pads 49 or shoes which directly engage each member 20 to be cut and clamp the same firmly to the work table 19 during the sawing action. At this time, the fence 22 is retracted rearwardly to be clear of the saw. Since the clamping frame ends 47 and pads 49 are separated, FIG.

5, the saw may enter between them to cleanly sever the member 20, the table 19 being open in the region of the saw.

The saw 31 includes a circular saw blade 50 operating in a vertical plane and having a rotatable arbor 51 driven by belt means 52 from an overhead motor 53 on a base plate 54, pivoted to a sub-plate 56 having a set screw 55 for adjustment of the plate 54 on its pivot. All of these parts are rotatable as a unit with and on the axis of the vertical pivot shaft 61 by manipulation of handle 62. Preferably integral with saw support arm 32 is a housing 58 for pivot shaft 61 having ball bearings 59 and 60 which receive the shaft 61 rotatably.

An important feature of the invention resides in means to accurately establish predetermined angles of cut for the saw 31 and to lock the saw in selected angularly adjusted positions so that it will faithfully and repetitively cut members 20 at prescribed angles following adjustment. This means comprises a detachable horizontal semi-circular angle plate 63 having an upstanding stem 64 detachably secured to the bracket plate 56 through a slotted head 65 and removable pin or screw 66 which engages through the bracket plate 56, as shown. Referring to FIG. 3, the angle plate 63 has a pair of concentric arcuate slots 67 and 68 formed therethrough for the reception of paired adjustable stop elements 69 and 70 which may be placed at any positions in the slots 67 and 68 to define accurately angles of cut for the saw blade 50 in relation to a coacting stop or contact arm 71. The contact arm 71 forms a part of a manual bell crank 72 pivoted at 73 to a lug on the housing 58. The contact arm 71 is illustrated in a neutral position relative to the sets of stops 69 and 70 and relative to the two slots 67 and 68. The contact arm 71 is shiftable upon its pivot 73 to either of two active positions shown in dotted lines in FIG. 3 where the contact arm 71 will lie in the path of travel of either the outer stops 69 or inner stops 70. These paired stops 69 and 70 may be adjusted to provide two angle ranges for the saw blade 50 during rotation by the handle 62. It is apparent that angle plate 63 may have more than two concentric arcuate slots 67 and 68.

Associated with the manual bell crank 72 is a pivoted detent lever 74 urged by a spring 75 into engagement with a cooperating three-position detent element 76 on, or forming a part of, the relatively stationary housing 58 in which the saw pivot shaft 61 is journaled. By this means, the contact arm 71 may be set in the neutral position as shown clear of the stops 69 and 70, or may be set to coact with either pair of stops 69 or 70 to define angle limits for the saw blade 50, as explained.

In order to positively lock the saw blade 50 in selected angular positions of use as when the contact arm 71 is against one of the stops 69 or 70, a split ring clamp 77 is provided to firmly grip the vertical pivot shaft 61 around its full circumference and this clamp is selectively set and released by a manual clamp screw 78, FIG. 4, or by automatic power means, in some cases, if preferred. The split clamp 77 is accurately machined to assure full circle contact with the pivot shaft 61 so that the same may be locked by the clamp with zero blacklash to further increase the accuracy of the machine. Zero backlash is obtained by a dowel pin which is pressed into both the bottom face of housing 58 and split clamp 77. Split clamp 77 is unaffected by discontinuities in vertical pivot shaft 61 such as holes or key slots as would a set screw or wedge type clamp because clamping pressure is distributed uniformally around shaft 61.

Figure 5:
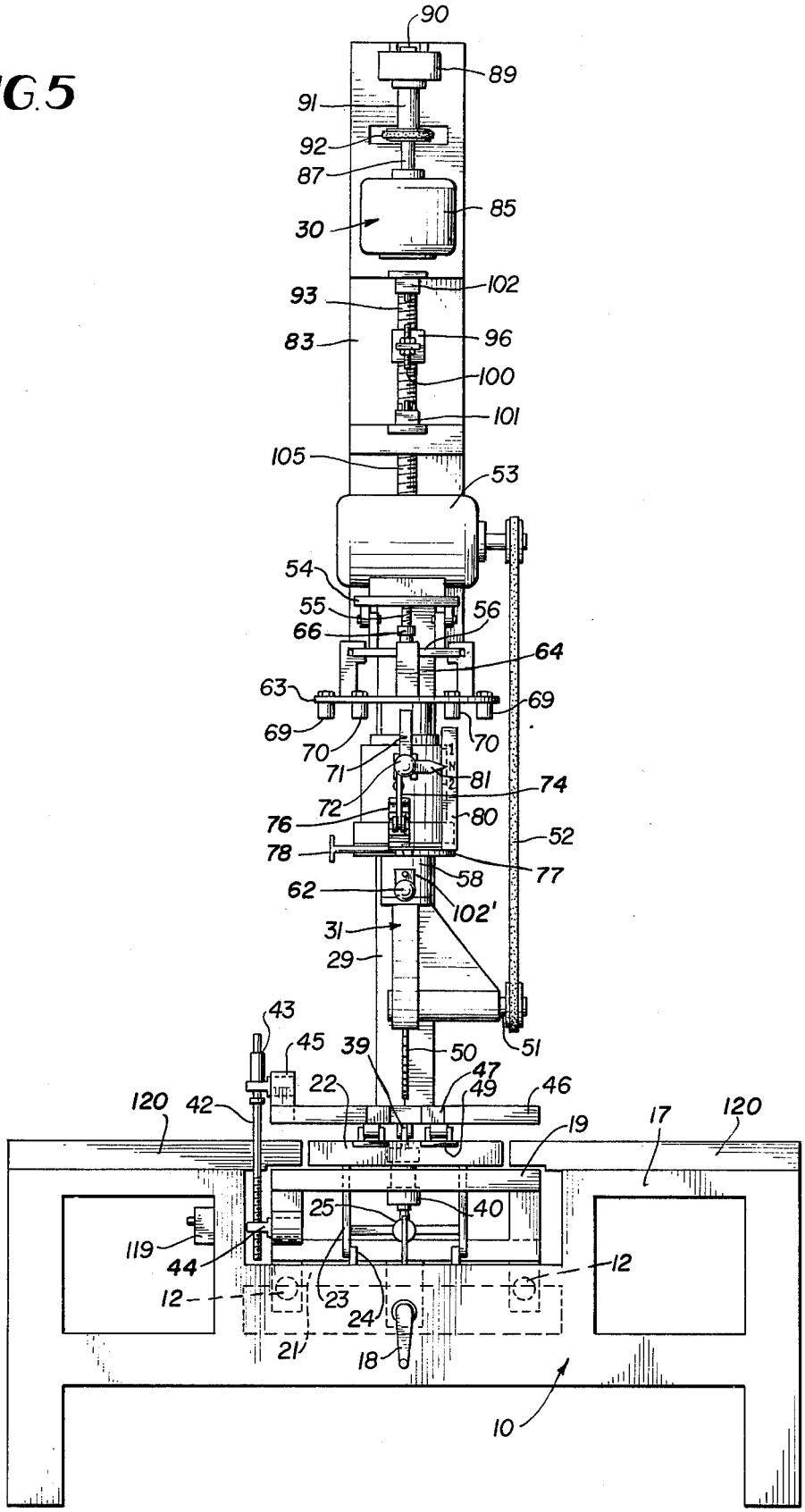
FIG. 5 is a front elevational view of the invention.

Associated with the bell crank 72 is a position indicator 80, FIG. 5, attached to the housing 58. A cooperating indicator pointer 81 is mounted on stop or contact arm 71 to give a visual indication of the position of the contact arm, whether neutral or in one of the two active positions relative to the stops 69 or 70.

The previously-noted power-operated vertical reciprocating means 30 for the power saw 31 includes a support head 82 fixed to the top of vertical post 29 and including an integral vertical support frame 83 extending above and below the same. The support frame 83 serves to mount a cooperating pair of drive motors 84 and 85 which have opposite directions of rotation for their driven shafts 86 and 87. Electric clutches 88 and 89 having housings tied to the top of the frame 83 at 90 also have rotational output shafts 91 which drive gearing 92 coupled with a center vertical rotary screw shaft 93 journaled for rotation in the frame 83 and having an electric brake 94 on its upper end tied to the frame 83 as at 95. The arrangement is such that the oppositely turning motors 84 and 85 run continuously and when either of the clutches 88 or 89 is activated, the shaft 93 will be driven rotationally in one direction or the other to drive a nut 96 upwardly or downwardly on the screw shaft 93. The nut is constrained against rotation by guidance of a nut pin 97 in a keyway 98 of the frame 83. The nut 96 carries at one side a pair of spaced vertical adjustable screw stops 99 and 100 for purposes to be described. Limit switches 101 and 102 on the frame 83 below and above the screw stops 99 and 100 cooperate with the latter, in a manner to be described. A manual control switch 102' is also provided on the pivot handle 62 of saw 31 for the control of the machine.

Preferably, a universal joint 104 connects screw shaft 93 with a lower screw shaft section 105, the two screw shaft sections being journaled for rotation on a common vertical axis in bearings 106 of the support frame 83. Another nut 107 drivably mounted on screw shaft section 105 is held against rotation by a pin means 108 and cooperating keyway 109. The nut 107 is operatively connected with the saw support arm 32 through a drive link 110 whereby upward or downward travel of the nut 107 raises or lowers the arm 32 and carriage 33 on the post 29 and causes vertical reciprocation of the saw 31 to thereby sever the truss members 20, rafters or the like at required angles of cut with accuracy and repetitive consistency. Drive screw 105 is selflocking to prevent saw blade 50 from descending in the event of the failure of spring 111 or brake 94 or their associated components.

A counterbalancing spring 111 for the reciprocating saw structure has its upper end attached to a radial arm 112 fixed on the support head 82. By properly positioning the spring 111, pivot 115 and the pivot points on 118 and 114 to which 117 is connected, the vertical component of force applied to carriage 34 may be very nearly matched to the weight of the carriage 34 and movable parts which move vertically with carriage 34 such that only a very small vertical force is required by the vertical drive system to vertically move the system. This results in motors 84 and 85 being of small horsepower, and also clutches 88 and 89 and brake 94 and associated drive line equipment being of small power rating.

During the operation of the sawing machine, the two motors 84 and 85 run continuously, as stated. The motor 53 which powers the saw blade 50 is also turned on and runs continuously. By operation of the control switch 119 conveniently located on the machine base 10 and through conventional pneumatic controls, not shown, the pneumatic cylinder 40 is activated to clamp the truss member 20 through the self-aligning pads 49 against the horizontal work table 19. As soon as the work is thus clamped, the pneumatic cylinder 25 retracts the short fence 22 clear of the path of movement of the saw blade 50. For positioning longer workpieces on the table 19, fixed fence sections 120 are provided on opposite sides of the retractable fence 22, FIG. 2.

With the workpiece 20, whether long or short, thus securely clamped and with the motors 84, 85 and 53 running, the operator closes the control switch 102' on saw handle 62 which de-activates shaft brake 94 and engages one clutch 88 or 89 to thereby transmit power to the central screw shaft 93–105 to turn the same in one direction, which results either in the lowering or raising of the saw blade 50 relative to the work 20. It may be assumed that closing of the switch 102' activates clutch 88 which through associated gearing 92 rotates shaft 93–105 in the direction to lower the saw blade 50 into the workpiece 20.

The saw blade 50 continues to descend while switch 102' is held closed. If the switch remains closed until limit stop 99 engages and activates limit switch 101, then clutch 88 is de-activated and brake 94 is engaged to stop screw shaft 93–105 without overtravel or drift.

When control switch 102' opens, brake 94 is released and and clutch 89 engages and through associated gearing 92 screw shaft 93–105 is driven in the opposite direction causing saw blade 50 to rise vertically. Clutch 89 remains engaged until limit stop 100 activates limit switch 102 which de-activates clutch 89 and engages brake 94 to stop screw 93–105 without overtravel or drift.

The described arrangement renders the operation of the machine rapid and substantially without lost time and motion, as would be the case if a single motor were employed in lieu of the two continuously operating motors 84 and 85. Such a single motor would require stopping and reversing each time the saw 31 is raised or lowered. The dual continuously operating motors and associated clutches and brake 94 renders the vertical reciprocation of the saw not only rapid but under very positive control of the operator at all times. It is believed that the advantages of the saw drive system are not readily apparent to those skilled in the art.

As previously noted, the machine is devised to handle wooden truss members for which cutting data requires either "fence line" cutting or "center line" cutting, the latter term referring to the center line of the workpiece 20. This machine adjustment is provided through the screw shaft 14 and crank 18 which shifts the carriage 11 on which the entire saw structure and its drive means are mounted including the work clamp means 46–49. Work fence 22 and work fence 120 do not move with adjustment of the carriage 11, being attached to the stationary base 10. Therefore, the adjustment of the carriage 11 by the screw shaft 14 shifts the vertical pivot shaft 61 of the saw relative to the fences 22 and 120 for either center line cutting, as illustrated in the present drawings, or fence line cutting, as required.

It will of course be understood that the angular adjustment of the saw blade 50 through the means shown in FIG. 3 and 4 and fully described above is entirely independent of the means to reciprocate the saw vertically and the arrangement is such that a wide range of angles may be cut on truss members and the like with great accuracy and consistency on a repetitive basis.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A power saw for cutting truss members and the like with accuracy comprising a relatively stationary base, a carriage movably mounted on the base for translation horizontally, means connected with the carriage to move it relative to the base, an upstanding guide and support post on the carriage and movable therewith, a power saw carrier arm guidably mounted on said post and movable therealong toward and away from the base, a power saw means on said carrier arm including a vertical axis pivot shaft for the power saw means to allow turning the power saw means to various angles, cooperating adjustable angle stop means for said vertical axis pivot shaft allowing the power saw means to be positioned accurately and repetitively at various cutting angles, means to releasably hold the power saw means in selected predetermined angular positions, a power drive means for said saw carrier arm on said upstanding guide and support post including a rotary screw shaft and a driven nut engaging said screw shaft and connected with the saw carrier arm to raise and lower it on said post, said power drive means additionally comprising a pair of oppositely turning drive motors for said screw shaft and being operatively coupled therewith, a clutch connected with each drive motor and adapted when energized to transmit power from that drive motor to said screw shaft for turning the screw shaft in one direction, a coacting brake for the screw shaft to prevent overtravel thereof when energized, limit switch means including switch actuators driven by the screw shaft to activate and deactivate said clutches and said brake, a workpiece table forming a part of said carriage, a power-operated work clamp on said carriage and above said table and operable to clamp workpieces to said table during the cutting thereof by the power saw means, and a retractable power-operated workpiece positioning fence on said relatively stationary base and adapted to engage and position workpieces resting on said table prior to clamping the workpieces and retracting from the workpieces after the clamping thereof to clear said power saw means.

2. A power saw for cutting truss members as defined in claim 1, and said means connected with the carriage to move it comprising a screw shaft on said base having threaded engagement with the carriage.

3. A power saw for cutting truss members as defined in claim 1, and return spring means for said power saw carrier arm on said guide and support post and biasing said carrier arm upwardly on said post and away from said base in such a manner that only a small amount of power is required to move said power saw carrier arm.

4. A power saw for cutting truss members as defined in claim 1, and said cooperating adjustable angle stop means comprising a manually adjustable contact arm on said saw carrier arm, detent means connected with said contact arm to hold it releasably in a neutral position or in one of a pair of active positions, an angle plate secured to said vertical axis pivot shaft and turning therewith, and cooperating pairs of adjustable stop elements carried by the angle plate and adapted to be releasably secured to the angle plate on opposite sides of said contact arm whereby the contact arm may arrest movement of the stop elements in said pairs when the contact arm is in either of said active positions.

5. A power saw for cutting truss members as defined in claim 1, and said means to releasably hold the power saw means in selected predetermined angular positions comprising a split ring clamp on said power saw carrier arm embracing said vertical axis pivot shaft, and means to draw the split ring clamp into tight clamping engagement with the vertical axis pivot shaft without backlash.

6. A power saw for cutting truss members as defined in claim 1, and said power-operated work clamp on said carriage comprising a vertically swingable frame, a pair of spaced self-aligning work clamping pads carried by said vertically swingable frame, and a power cylinder means connected with said carriage and frame and operable to draw said frame and pads into clamping engagement with workpieces resting on said table, said table having spaced work rest portions underlying said pads whereby the blade of the power saw means may enter between said pads and said work rest portions during cutting of a truss member or the like at a prescribed angle.

7. A power saw for cutting truss members as defined in claim 1, and said retractable power-operated workpiece positioning fence comprising a vertically swingable frame pivoted to said base and projecting through an opening of said table and above the top of the table and including a work positioning fence element at its top and above the table, and a power cylinder means connected with said frame and said base below said table.

8. A power saw means for cutting truss members as defined in claim 4, wherein said angle plate is releasably secured to said vertical axis pivot shaft and has a pair of concentric arcuate slots formed therethrough and radially spaced from the axis of the pivot shaft, said pairs of adjustable stop elements being engaged through said slots and adapted for clamping at selected spaced apart positions in said slots.

9. A power saw means for cutting truss members as defined in claim 1, and said power saw means including a circular saw blade and driving arbor on the lower end of the vertical axis of the pivot shaft, a saw blade driving motor and motor support means on the upper end of said pivot shaft, and power transmitting means interconnecting said motor and said arbor.

10. A power saw means for cutting truss members as defined in claim 9, and a vertical axis housing for said pivot shaft on said power saw carrier arm including vertically spaced coaxial bearings for the pivot shaft.

11. A power saw means for cutting truss members as defined in claim 10, and a handle extension on said pivot shaft to facilitate turning the power saw means to various angular positions regulated by said adjustable angle stop means.

12. A power saw means for cutting truss members as defined in claim 11, and an operator's control switch for said oppositely turning drive motors and said coacting brake on said handle extension.

13. A power saw for cutting truss members as defined in claim 1, and a second nut having threaded engagement with said screw shaft and carrying said limit switch actuators, and a pair of limit switches on said power drive means above and below said actuators, one limit switch aligned operatively with each actuator.

14. A power saw for cutting truss members as defined in claim 1, and a support frame for said rotary screw shaft on the top of said support post including bearing means for said screw shaft, and said oppositely turning drive motors, clutches and said brake mounted on said support frame.

* * * * *